US010050400B2

(12) United States Patent
Eckel et al.

(10) Patent No.: US 10,050,400 B2
(45) Date of Patent: Aug. 14, 2018

(54) CONNECTION CAGE FOR CONNECTING TWO ELECTRICAL FLAT CONTACTS

(71) Applicant: TE Connectivity Germany GmbH, Bensheim (DE)

(72) Inventors: Markus Eckel, Burstadt (DE); Harald Ulrich, Fischbachtal (DE); Konstantin Zech, Leimen (DE); Christoph Kosmalski, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/609,478

(22) Filed: May 31, 2017

(65) Prior Publication Data

US 2017/0346248 A1 Nov. 30, 2017

(30) Foreign Application Priority Data

May 31, 2016 (DE) ..... 10 2016 209 478

(51) Int. Cl.

| | |
|---|---|
| ***H01R 33/94*** | (2006.01) |
| ***H01R 13/22*** | (2006.01) |
| ***H01R 13/631*** | (2006.01) |
| ***H01R 4/48*** | (2006.01) |
| ***H01R 11/03*** | (2006.01) |
| *H01R 13/11* | (2006.01) |
| *H01R 13/15* | (2006.01) |
| *H01R 31/06* | (2006.01) |
| *H01R 31/08* | (2006.01) |

(52) U.S. Cl.

CPC ..... *H01R 33/94* (2013.01); *H01R 4/48* (2013.01); *H01R 11/03* (2013.01); *H01R 13/22* (2013.01); *H01R 13/631* (2013.01); *H01R 13/113* (2013.01); *H01R 13/15* (2013.01); *H01R 31/06* (2013.01); *H01R 31/08* (2013.01)

(58) Field of Classification Search

CPC ..... H01R 4/48; H01R 13/113
USPC ..... 439/786, 861, 787
See application file for complete search history.

(56) References Cited

U.S. PATENT DOCUMENTS

| | | | | |
|---|---|---|---|---|
| 2,319,122 A * | 5/1943 | Funk | ..... | H01R 13/20 439/708 |
| 2,537,370 A * | 1/1951 | Parnes | ..... | H01R 13/44 439/693 |
| 2,685,720 A * | 8/1954 | Petri | ..... | F16B 2/241 403/206 |

(Continued)

FOREIGN PATENT DOCUMENTS

| | | |
|---|---|---|
| DE | 3330984 A1 | 3/1985 |
| DE | 4001857 A1 | 8/1990 |

(Continued)

OTHER PUBLICATIONS

German Office Action, dated Apr. 13, 2017, 6 pages.
European Search Report, dated Aug. 23, 2017, 7 pages.

*Primary Examiner* — Neil Abrams
(74) *Attorney, Agent, or Firm* — Barley Snyder

(57) ABSTRACT

A connection cage for connecting two electrical flat contacts with a first flat contact receptacle for a first flat contact, which is accessible from the outside through a first insertion opening along a first insertion direction, and a second flat contact receptacle for a second flat contact, which is accessible from the outside through a second insertion opening along a second insertion direction.

15 Claims, 6 Drawing Sheets

(56) References Cited

U.S. PATENT DOCUMENTS 2,997,685 A * 8/1961 Anderson ..... H01R 4/4809 439/625
3,273,102 A * 9/1966 Cobaugh ..... H01R 4/2491 439/49
3,526,870 A * 9/1970 Mayala ..... H01R 4/2491 403/395
3,636,505 A * 1/1972 Poltonavage ..... H01R 31/02 439/787
3,659,243 A * 4/1972 Gluntz ..... H01R 13/11 439/525
3,744,006 A * 7/1973 O'Loughlin ..... H01R 4/50 439/393
3,918,784 A * 11/1975 Lemke ..... H05K 7/1038 439/387
3,918,788 A * 11/1975 Walter ..... H01R 9/00 174/72 B
3,980,378 A * 9/1976 Keller ..... H01R 4/5041 439/435
4,006,960 A * 2/1977 Lacan ..... H01R 4/4809 439/625
4,039,239 A * 8/1977 Cobaugh ..... H01R 4/2491 439/398
4,087,149 A * 5/1978 Fischer ..... H01R 4/4818 439/435
4,128,290 A * 12/1978 Mickelson ..... H01R 4/2491 439/391
4,451,109 A * 5/1984 Inoue ..... H01H 85/2035 439/786
4,637,677 A * 1/1987 Barkus ..... H01R 4/52 439/724
4,703,397 A * 10/1987 Minoura ..... B60R 16/0239 361/752
4,740,171 A * 4/1988 Holden ..... H01R 4/2454 439/191
4,894,020 A * 1/1990 Holden ..... A47L 9/246 29/857
4,909,744 A * 3/1990 Muto ..... H01R 31/085 439/210
4,966,563 A * 10/1990 Pierce ..... H01R 25/142 439/729
4,992,062 A 2/1991 Nakayama et al.
5,030,116 A * 7/1991 Sakai ..... F02M 51/005 123/456
5,421,749 A * 6/1995 Schrauder ..... H01R 4/4809 439/729
5,554,040 A * 9/1996 Sugiura ..... H01R 25/14 439/212
5,603,626 A * 2/1997 Oka ..... H01H 85/2035 439/224
5,911,605 A * 6/1999 Wooldridge ..... H01R 13/28 439/790
5,980,311 A * 11/1999 Campbell ..... H01R 33/945 361/668
6,315,591 B2 * 11/2001 Oda ..... H01R 13/18 439/246
6,416,340 B2 * 7/2002 Schaefer ..... H01R 13/187 439/224
6,629,853 B2 * 10/2003 Whiteman, Jr. ... H01R 13/6315 439/246
6,773,314 B2 * 8/2004 Mills ..... H01R 4/48 439/850
6,932,625 B2 * 8/2005 Yagi ..... H01R 31/08 439/76.2
7,175,488 B2 * 2/2007 Pavlovic ..... H01R 13/113 439/620.27
7,489,284 B2 * 2/2009 Shih ..... H01Q 1/1207 343/878
8,075,326 B2 * 12/2011 Quiter ..... H01R 4/4809 439/224
8,303,349 B2 * 11/2012 Shmukler ..... H01R 13/2435 439/724
8,715,018 B2 * 5/2014 Yoshikawa ..... H01R 13/187 439/850
8,771,027 B2 * 7/2014 Zhang ..... H01R 4/48 439/835
8,795,005 B2 * 8/2014 Blakborn ..... H01R 13/113 439/788
8,827,754 B2 * 9/2014 Lee ..... H01R 13/113 439/843
8,992,269 B2 * 3/2015 Salzmann ..... H01R 4/48 439/828
9,722,328 B2 * 8/2017 Wimmer ..... H01R 4/489
9,780,464 B2 * 10/2017 Wortberg ..... H01R 4/48
9,793,620 B2 * 10/2017 Marsh ..... H01R 4/4809
2017/0346248 A1 * 11/2017 Eckel ..... H01R 33/94

FOREIGN PATENT DOCUMENTS

DE 102011085700 A1 5/2013
DE 102012206731 A1 10/2013
DE 102013106117 A1 12/2014
EP 3136516 A1 3/2017
FR 2701338 A1 2/1993

* cited by examiner

CONNECTION CAGE FOR CONNECTING TWO ELECTRICAL FLAT CONTACTS

CROSS-REFERENCE TO RELATED APPLICATION

This application claims the benefit of the filing date under 35 U.S.C. § 119(a)-(d) of German Patent Application No. 102016209478.5 filed on May 31, 2016.

FIELD OF THE INVENTION

The present invention relates, in general, to a connection cage and, in particular, to a connection cage for connecting two electrical flat contacts.

BACKGROUND

Connection cages and corresponding plug-in systems are intended to electrically connect two flat contacts with one another. The flat contacts can be fitted or inserted into flat contact receptacles. Resiliently deflectable press-on means then press the second flat contact against the first flat contact, with contact surfaces of the flat contacts preferably being arranged abutting one another. Flat contacts can be, for example, cable lugs, bus bars, or compacted ends of flat ribbon cables, respectively, with or without covering.

Depending on the design of the flat contacts, the optimal positioning of the two flat contacts relative to one another, in particular, with regard to their contact surfaces, can be difficult. This is the case, in particular, if one of the flat contacts differs from a form that is normal for a flat contact. This can be the case, for example, if one of the flat contacts has additional elements, such as an insulating member.

SUMMARY

A connection cage for connecting two electrical flat contacts, constructed in accordance with the present invention, has a first flat contact receptacle for a first flat contact and a second flat contact receptacle, facing the first contact receptacle, for a second flat contact. The first flat contact receptacle is accessible from outside the connection cage through a first insertion opening along a first insertion direction and the second flat contact receptacle is accessible from outside the connection cage though a second insertion opening along a second insertion direction. This connection cage also has at least one resiliently deflectable press-on means positioned on a side of the second flat contact receptacle opposite from the first flat contact receptacle and projects at least in sections into the second flat contact receptacle.

Hereinafter, the invention is explained in greater detail by way of example using an advantageous embodiment with reference to the drawings. The combination of features depicted by way of example in the embodiment can be supplemented accordingly by additional features for a particular application in accordance with the statements above. It is also possible, likewise in accordance with the statements above, for individual features to be omitted in the described embodiment, if the effect of this feature is not important in a specific application.

BRIEF DESCRIPTION OF THE DRAWINGS

In the drawings, the same reference numbers are used consistently for elements with the same function and/or the same structure.

In the drawings.

DETAILED DESCRIPTION OF THE EMBODIMENT(S)

Figure 1:
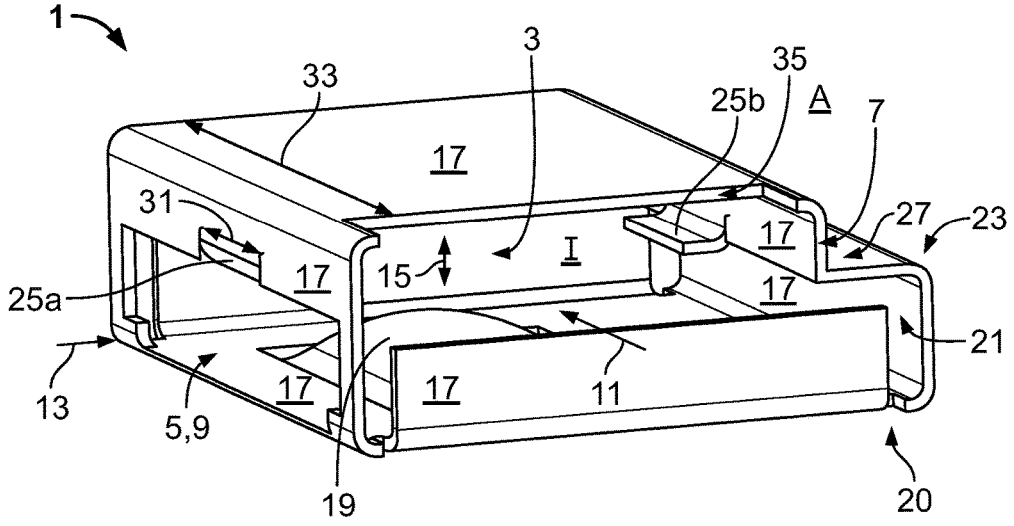
FIG. 1 is a perspective view of a connection cage according to the present invention.
Figure 2:
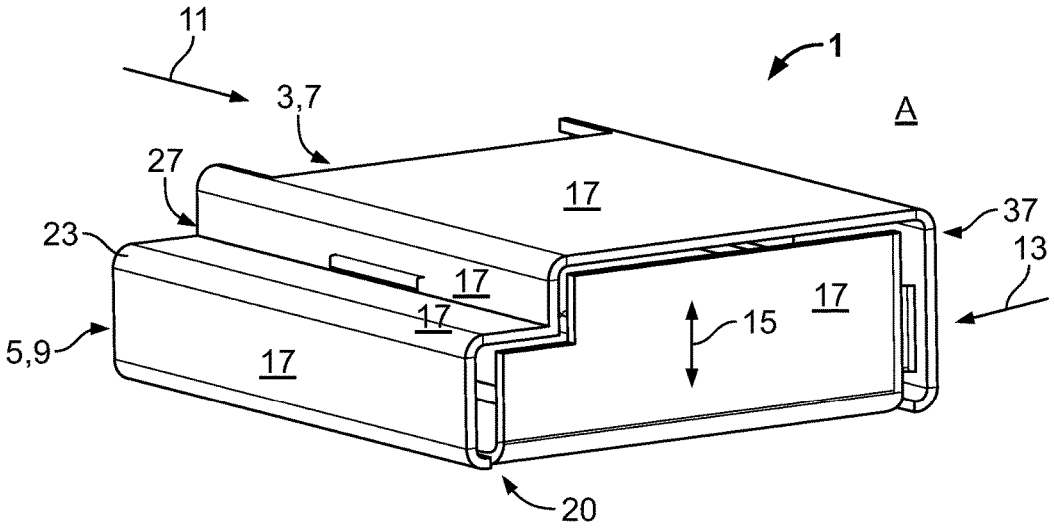
FIG. 2 shows the connection cage of FIG. 1 from another perspective.
Figure 3:
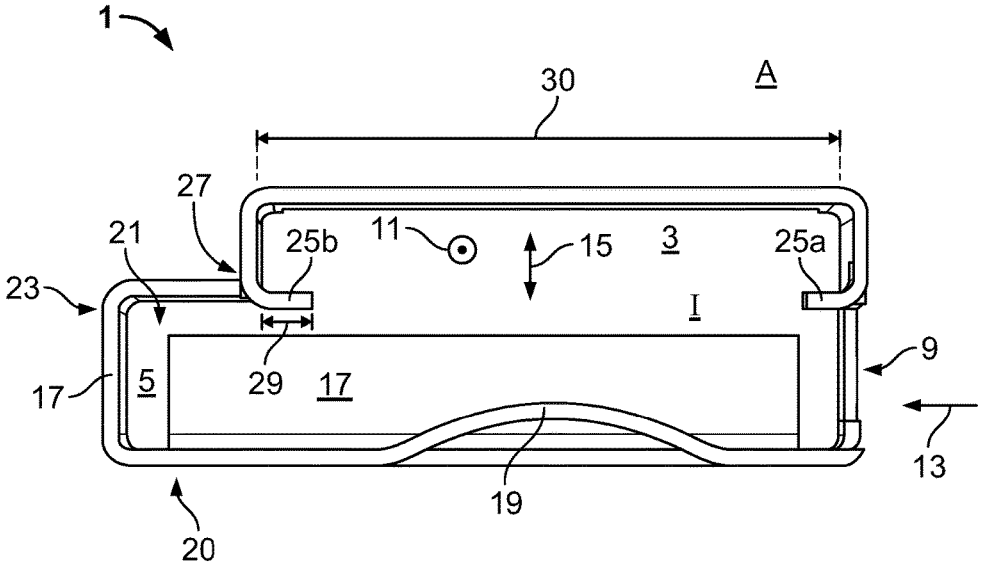
FIG. 3 shows a cross-section through the connection case of FIG. 1 with a viewing direction which is parallel to a first insertion direction.

Referring to FIGS. 1, 2, and 3, a connection cage 1, according to the present invention, has a first flat contact receptacle 3 and a second flat contact receptacle 5. The first flat contact receptacle 3 and the second flat contact receptacle 5 receive electrical flat contacts (not shown in FIGS. 1, 2, and 3).

The first flat contact receptacle 3 is accessible from the outside A through a first insertion opening 7 for a first flat contact and the second flat contact receptacle 5 is accessible from the outside A through a second insertion opening 9 for a second flat contact.

A flat contact can be introduced along a first insertion direction 11 from the outside A through the first insertion opening 7 into the first flat contact receptacle 3. A flat contact can be introduced along a second insertion direction 13 from the outside A through the second insertion opening 9 into the second flat contact receptacle 5.

In the embodiment of the invention illustrated and being described, the insertion directions 11 and 13 run perpendicular to one another. This enables a 90° arrangement of the two flat contacts. While this orientation represents a preferred orientation of the insertion directions 11 and 13 to one another, the invention is not limited thereto. The insertion directions 11 and 13 can also run parallel to one another, so that there can be a 180° or a 360° arrangement for the two flat contacts. Other orientations are also possible.

Both flat contact receptacles 3 and 5 have a flat form which is appropriate for receiving flat contacts. That is to say, they extend further in a plane which runs parallel to both of the insertion directions 11 and 13 rather than in an elevation direction 15 which runs perpendicular to both insertion directions 11 and 13. Flat contact receptacles 3 and 5 are adjacent to one another in the elevation direction 15 and form a common interior I of the connection cage 1.

With the exception of the insertion openings 7 and 9, the interior I of the connection cage preferably is closed off to the outside A by walls 17. The connection cage 1 preferably has no other openings which are large enough to enable a flat contact, a tool, or a finger to gain entry. However, gaps or openings caused by manufacturing can be present, provided that they are small enough that a finger or a flat contact provided for one of the flat contact receptacles 3 or 5 cannot enter therein.

The connection cage 1 has a resiliently deflectable press-on means 19 that presses a second flat contact, which is arranged in the second flat contact receptacle, against a first flat contact, which is in the first flat contact receptacle. For this purpose, the resiliently deflectable press-on means 19 projects, at least in sections, into the second flat contact receptacle and is preferably resiliently deflectable away from the first flat contact receptacle, parallel to the elevation direction 15.

The particular design of the resiliently deflectable press-on means 19 is only given as an example. It is also possible for the connection cage 1, according to the present invention, to have several press-on means 19. Ideally, the press-on means 19 is arranged in the elevation direction 15 opposite the first flat contact receptacle. Preferably, the press-on means 19 is formed monolithically with that wall 17 of the connection cage 1 which is opposite the first flat contact receptacle 3.

The connection cage 1 is preferably made of a metal. It is particularly preferred that the connection cage 1 is formed of spring steel. A connection cage 1 made of metal can be conductive to the heat conduction of the heat which is emitted by current-carrying flat contacts. A connection cage 1 which is formed of spring steel additionally is highly stable and can help to ensure that a press-on means 19, which is formed monolithically with the connection cage 1, has good spring properties. That is to say, on the one hand, it is repeatedly resiliently deflectable and, on the other hand, high spring force can be achieved.

Alternatively, the connection cage 1 can be made of other materials. If heat conductivity is not important, then the connection cage 1 can be made of plastics, for example. If the connection cage 1 is intended to additionally contribute to the electrical conduction between two flat contacts received inside it, the connection cage 1 can also have metals which are highly electrically conductive. The connection cage 1 can be made as a punched bent part, for example.

The second flat contact receptacle 5 projects beyond the first flat contact receptacle 3 in the second insertion direction 13. The second flat contact receptacle, thus, has a protrusion 23 which projects beyond the first flat contact receptacle 3.

In the interior I of the connection cage 1, the protrusion 23, which projects beyond the first flat contact receptacle 3, has a recess 21 in the wall 17 which is opposite the second insertion opening 9. Protrusion 23, which protrudes in the second insertion direction 13 relative to the rest of the connection cage 1, is on the outside A.

Preferably, the second flat contact receptacle 5 extends over its entire cross-section, which runs transversely to the second insertion direction 13, into the recess 21. The wall 17 opposite the second insertion opening 9, which represents that end of the second flat contact receptacle 5 which is located in the second insertion direction 13, is preferably fully closed. The wall 17 opposite the second insertion opening 9 can represent a blocking element for a flat contact in the second flat contact receptacle 5.

The protrusion 23 preferably does not extend to the height of the first flat contact receptacle 3 in the elevation direction 15. Therefore, a part of a flat contact which is received in the recess 21 can be well protected from influences from the outside A.

Two retainers 25*a* and 25*b* extend between the first flat contact receptacle 3 and the second flat contact receptacle 5 into the interior I of the connection cage 1. Overall, both of the retainers 25*a* and 25*b* are flat and extend in a plane which runs transversely to the elevation direction 15. Both of the retainers 25*a* and 25*b* are opposite one another in the second insertion direction 13. Both of the retainers 25*a* and 25*b* hold or fix a flat contact in the first flat contact receptacle 3.

Retainer 25*a* extends from the wall 17, which has the second insertion opening 9, in the direction of the opposite wall 17. Retainer 25*b* extends from a wall 17, which is opposite the second insertion opening 9 and which runs transversely to the second insertion direction 13, in the direction of the second insertion opening 9.

The retainer 25*b* extends from a wall 17, which represents that end of the first flat contact receptacle 3 which is opposite the second insertion opening 9. That is to say, the retainer 25*b* extends from a transition region 27 between the first flat contact receptacle 3 and the recess 21. The retainers 25*a* and 25*b* are preferably arranged approximately centrally in the connection cage 1 in the first insertion direction 11.

In order not to excessively impair an electrical contact between two flat contacts which are received in the connection cage 1, a depth 29 of each of the retainers 25*a* and 25*b* extends parallel to the second insertion direction 13, in each case preferably no more than ¼ of a width 30 of the first flat contact receptacle 3 seen transversely to the first insertion direction 11. Preferably, a width 31 of the retainer 25 is approximately ⅓ of the length 33 of the first flat contact receptacle 3 seen in the first insertion direction 11. Preferably, the width 31 is not more than half of the length 33.

Depending on the design of the flat contacts to be used, the insertion openings 7 and 9 can, in each case, also extend over more than one wall 17. This is depicted only by way of example for the first flat contact receptacle 3. The first insertion opening 7 not only extends in a wall 17 which runs transversely to the first insertion direction 11, but also in the wall 17 which is opposite the press-on means 19. That is to say, this wall 17 has a recess 35 which extends into the wall 17 in the first insertion direction 11.

As a result of the second flat contact receptacle 5 projecting in the second insertion direction 13 beyond the first flat contact receptacle 3, or through the protrusion 23 formed therefrom, the connection cage 1, viewed in the first insertion direction 11, has a cross-section which has no axes of symmetry. Through this form, a safeguard against incorrect plug insertion 37 can consequently be established, which can prevent the connection cage 1 from being fitted into a casing in a wrong orientation.

Figure 4:
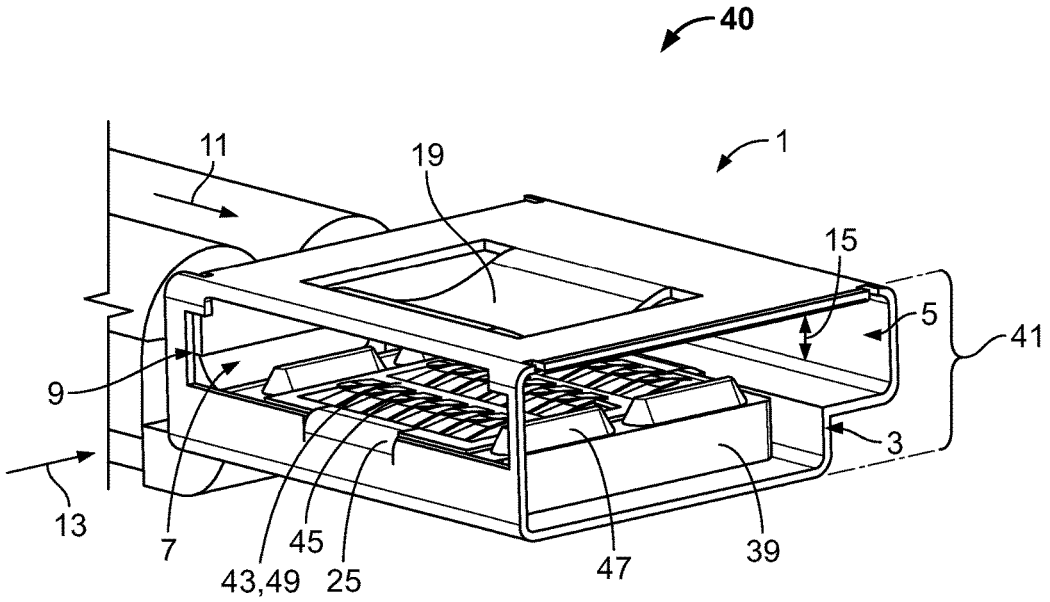
FIG. 4 is a perspective view of the connection cage of FIG. 1 with a fitted first flat contact.

FIG. 4 shows the connection cage 1, according to the present invention, with a first flat contact 39 in the first flat contact receptacle 3. For the sake of visibility, the wall 17, which is opposite the first insertion opening 7, is not depicted in FIG. 4. The connection cage 1 and the first flat contact 39 together form a plug-in system 40 according to the present invention.

The first flat contact 39 is held and fixed in the first flat contact receptacle 3 by the retainer 25. The connection cage 1 and the first flat contact 39 form a unit 41. As the unit 41 for connecting with a second flat contact (not shown) has the second flat contact receptacle 5 and the associated second insertion opening 9, the unit 41 can be viewed as a female connector for a second flat contact.

The first flat contact 39 has a contact surface 43. This contact surface 43 can have contact springs 45 which extend away from the contact surface 43 and which are resiliently deflectable thereon. These contact springs 45 can improve the electrical connection to a second flat contact.

Similarly, it is advantageous when the first flat contact 39 has guiding elements 47 by means of which a second flat contact can be guided along the second insertion direction 13. The guiding elements 47 are depicted merely by way of example as guide rails running parallel to the second insertion direction 13. The guiding elements 47 are preferably located at ends of the flat contact 39 which are opposite one another in the first insertion direction 11, such that the contact surface 43 is arranged between the guiding elements 47.

If the first flat contact 39 is in the first flat contact receptacle 3, the contact surface 43 forms a side wall 49 of the second flat contact receptacle 5. The contact surface 43 is opposite the press-on means 19 and extends transversely to the elevation direction 15.

Figure 5:
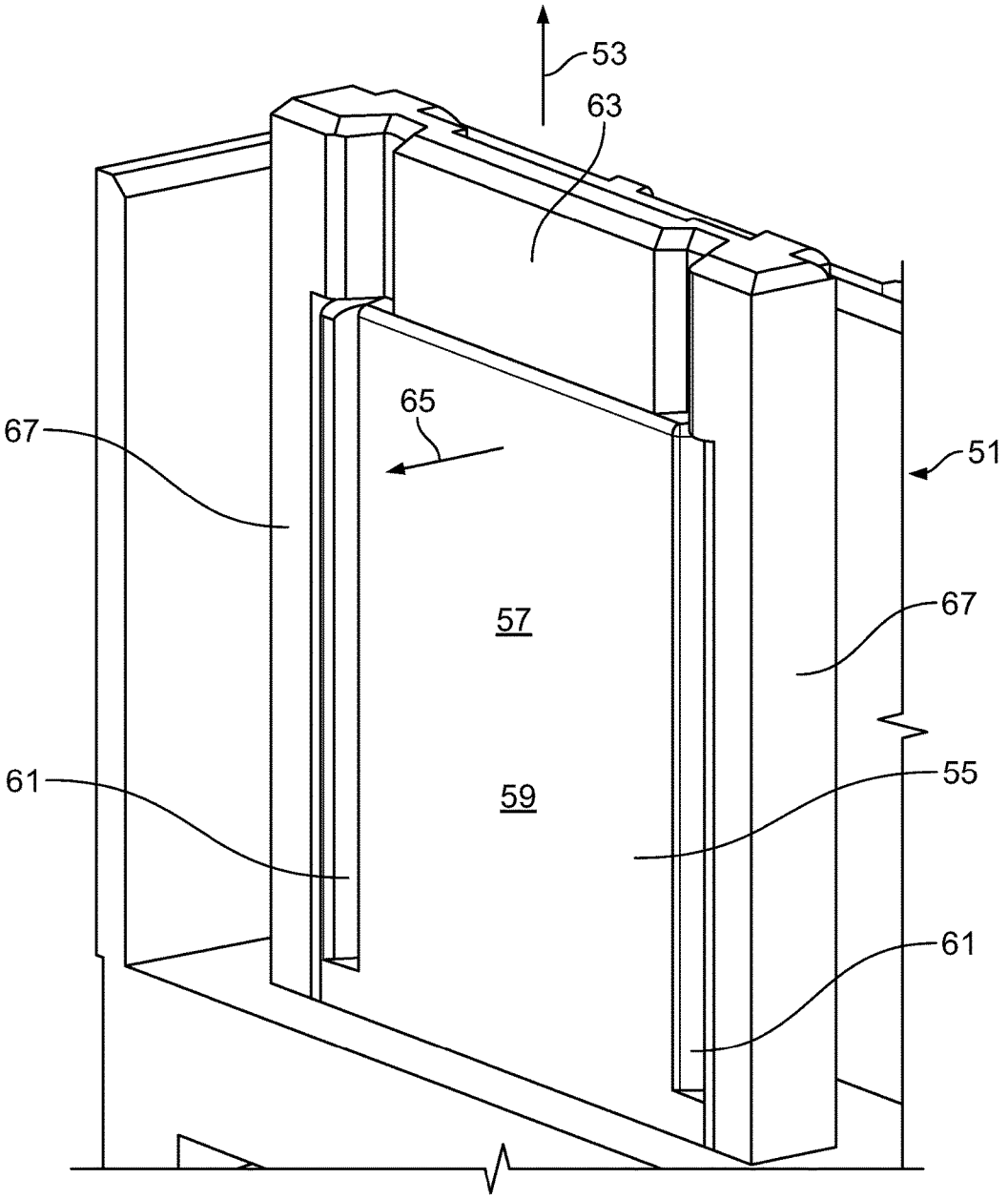
FIG. 5 is a perspective view of a second flat contact with an insulating member.

FIG. 5 shows a second flat contact 51 which is received in the second flat contact receptacle 5 and can be part of the plug-in system 40 according to the present invention. The second flat contact 51 extends in an insertion direction 53 which preferably coincides with the second insertion direction 13 when connecting with the connection cage 1 according to the present invention. Preferably, the second flat contact 51 has an elongated form which extends in the insertion direction 53.

The second flat contact 51 has an electrically conductive part 55 which, in turn, has the contact surface 57. Preferably, the electrically conductive part 55 is made of a metal. The contact surface 57 preferably has a continuous, smooth surface 59.

The contact surface 57 can be laterally limited by guiding elements 61 which run parallel to the insertion direction 53 and which are preferably formed complementary to the guiding elements 47 of the first flat contact 39. The guiding elements 61 of the second flat contact are depicted merely by way of example as guiding grooves which are shaped to receive the guiding elements 47 of the first flat contact 39 which are designed as guiding rails.

The second flat contact 51 has an electrically non-conductive insulating member 63 which, in the insertion direction 53, is upstream of the contact surface 57, that is, at the end face. In order to facilitate the insertion of the second flat contact 51 into the second flat contact receptacle 5, the insulating member 63 does not project beyond the contact surface 57 in the direction of a surface normal 65 of the contact surface 57. The insulating member 63 has side arms 67 which, running parallel to the insertion direction 53, border the electrically conductive part 55.

The insulating member 63 serves to prevent an operator, a tool, or any other object from touching the electrically conductive part 55 while the second flat contact 51 is being handled.

Figure 6:
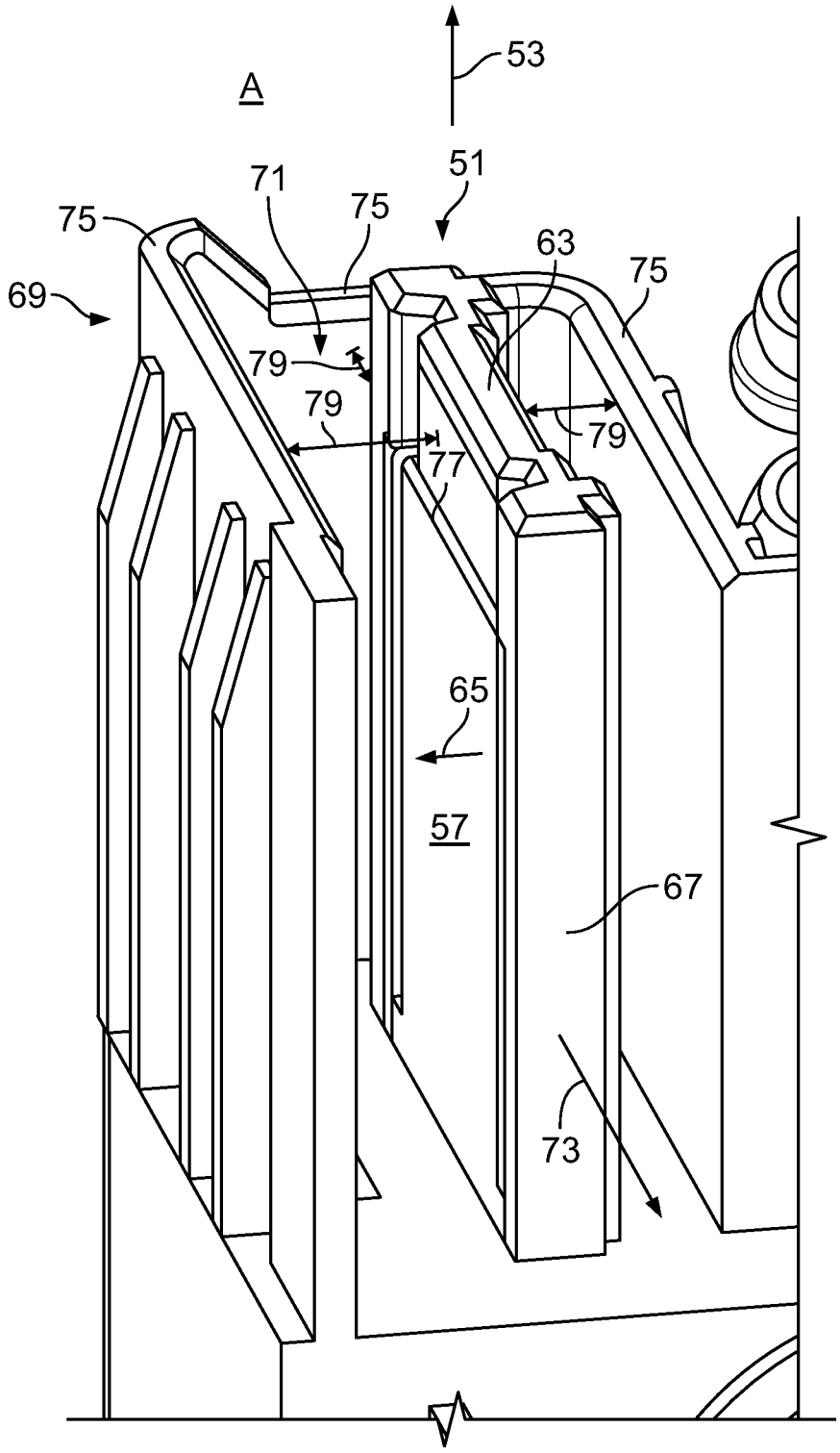
FIG. 6 is a perspective view of the second flat contact of FIG. 5 with a surrounding casing.

In FIG. 6, the second flat contact 51 is depicted with a casing 69 which partially surrounds it. The casing 69 is preferably electrically non-conductive. The casing 69 can be integrally formed with the side arms 67 and the insulating member 63.

The second flat contact 51 is free to move outwardly to A through the receiving shaft 71 in the insertion direction 53. Additionally, the second flat contact 51 is free to move through the receiving shaft 71 in a side direction 73 which runs transversely to the insertion direction 53 and transversely to the surface normal 65 of the contact surface 57. In a connected state V, as it is described with regard to FIGS. 7 and 8, the side direction 73 is parallel to the first insertion direction 11 and pointing opposite it.

The side walls 75 of the casing 69 project beyond the end-face end 77 of the contact surface 57 in the insertion direction 53. Therefore, the side walls 75 and the insulating member 63 are upstream of the end face 77 in the insertion direction 53. As a result, the contact surface 57 is protected against contact from the outside A.

The distances 79, between the flat contact 51 and the side walls 57, are preferably selected such that a finger, for example a test finger according to DIN EN 60.529, cannot enter the receiving shaft 71. As a result, the casing 69 and the insulating member 63 form an effective finger protection. In the side direction 73, the contact surface 57 is protected by the side arm 67 and the side walls 75 against contact.

Figure 7:
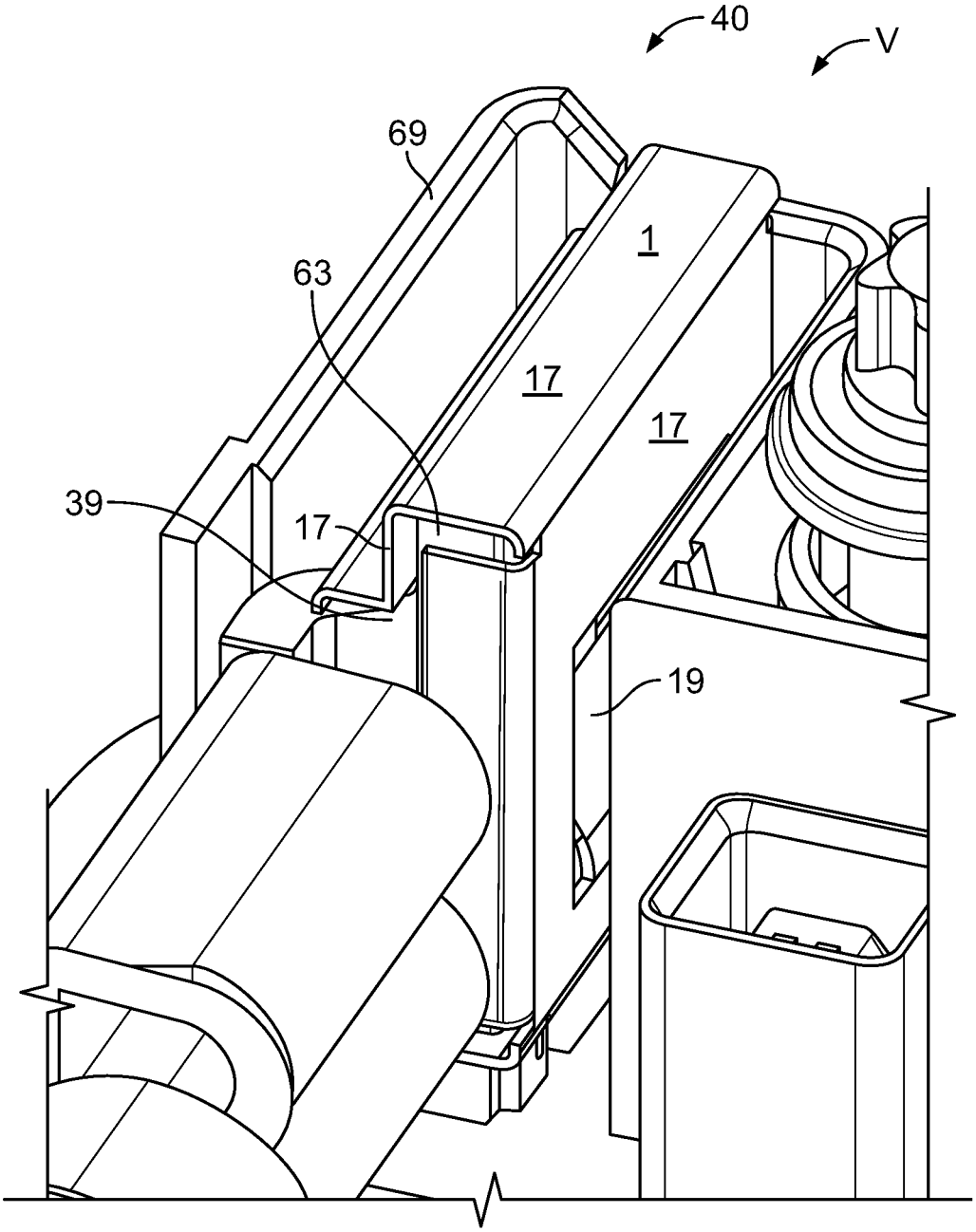
FIG. 7 is a perspective view of the second flat contact of FIG. 6 in a state in which it is connected to a first flat contact.
Figure 8:
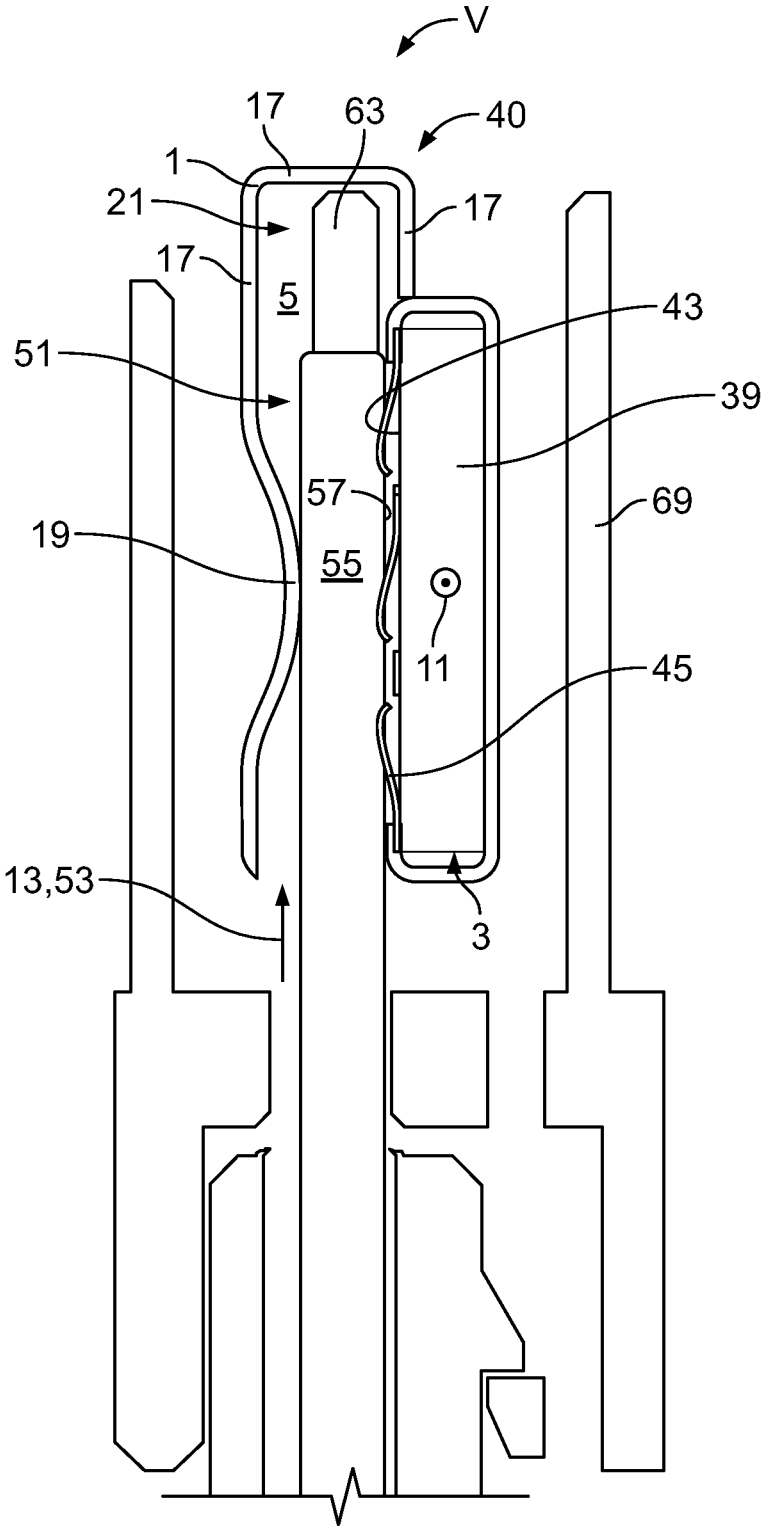
FIG. 8 shows a cross-section through the second flat contact of FIG. 7.

FIGS. 7 and 8 show the second flat contact 51 in a connected state V with a connection cage 1 according to the present invention and a first flat contact 39. FIG. 8 shows a cross-section through the plug-in system 40 according to the present invention in the region of the press-on means 19 with a viewing direction which is parallel to the first insertion direction 11.

The first flat contact 39, as is described with regard to FIG. 4, is received in the first flat contact receptacle 3. The second flat contact 51 is received in the second flat contact receptacle 5. The contact surface 57 abuts the contact surface 43 of the first flat contact. An electrical contact is thereby developed via the contact springs 45 of the first flat contact. However, the contact springs 45 are only optional. Flat contacts 39 with contact surfaces 43 without contact springs 45 can also be used.

The second flat contact 51 is pushed against the first flat contact 39 by the resiliently deflectable press-on means 19. The insulating member 63 is received in the recess 21 of the connection cage 1. In the connected state V, the insulating member 63 projects beyond the contact surface 43 of the first flat contact 39 (i.e., in the second insertion direction 13). As a result, the second flat contact 51 can extend sufficiently deeply into the second flat contact receptacle 5, such that there is a sufficient overlap between the contact surfaces 57 and 43 of the flat contacts 51 and 39, respectively. At the same time, the insulating member 63 is protected by the walls 17 which surround it.

The use of the plug-in system 40 according to the present invention is briefly described by way of example. First, the first flat contact 39 can be pushed along the first insertion direction 11 into the first flat contact receptacle 3. If the first flat contact 39 is held securely in the connection cage 1 by the retainers 25, then these two elements form the unit 41.

This unit 41 can then be moved opposite the insertion direction 53 of the second flat contact 51 towards it, such that the second flat contact 51 is pushed into the second flat contact receptacle 5 in its insertion direction 53 and simultaneously in the second insertion direction 13. The resiliently deflectable press-on means 19 is thereby deflected away from the second flat contact 51 and exerts a spring pressure which presses the second flat contact 51 against the first flat contact 39.

The unit 41 is pushed as far onto the second flat contact 51 until the insulating member 63 is received in the recess 21. In this state, the contact surfaces 57 and 43 overlap such that there is an optimal electrical connection between the flat contacts 39 and 51. To release the contact, the reverse sequence is performed.

What is claimed is:

1. A connection cage for connecting two electrical flat contacts comprising:

a first flat contact receptacle for a first flat contact accessible from outside the connection cage through a first insertion opening along a first insertion direction;

a second flat contact receptacle for a second flat contact:

(a) facing the first contact receptacle, (b) accessible from outside the connection cage though a second insertion opening along a second insertion direction, and (c) projecting beyond the first flat contact receptacle in the second insertion direction; and at least one resiliently deflectable press-on means:

(a) positioned on a side of the second flat contact receptacle opposite from the first flat contact receptacle, and (b) projecting at least in sections into the second flat contact receptacle.

2. The connection cage according to claim 1, wherein an external wall of the connection cage has, opposite the second insertion opening, a protrusion which protrudes in the second insertion direction relative to the rest of the connection cage.

3. The connection cage according to claim 2, wherein the interior of the connection cage in the region of the protrusion is fully closed to the outside by external walls.

4. The connection cage according to claim 1, wherein, except for the first and second insertion openings, the interior of the connection cage is closed off to the outside by external walls.

5. The connection cage according to claim 1, further including at least one retainer in the interior of the connection cage adapted to hold the first flat contact in the first flat contact receptacle.

6. The connection cage according to claim 1, further including two retainers between the first and the second flat contact receptacles and opposite one another transverse to the first insertion direction.

7. The connection cage according to claim 4, wherein the walls of the connection cage are formed as an integral unit.

8. The connection cage according to claim to 7, wherein the connection cage is made of a metal.

9. The connection cage according to claim 1, wherein the first insertion direction is perpendicular to the second insertion direction.

10. A plug-in system comprising:

a connection cage having:

(a) a first flat contact receptacle for a first flat contact accessible from outside the connection cage through a first insertion opening along a first insertion direction;

(b) a second flat contact receptacle for a second flat contact:

(1) facing the first contact receptacle, (2) accessible from outside the connection cage though a second insertion opening along a second insertion direction, and (3) projecting beyond the first flat contact receptacle in the second insertion direction, and (c) at least one resiliently deflectable press-on means:

(1) positioned on a side of the second flat contact receptacle opposite from the first flat contact receptacle, and (2) projecting at least in sections into the second flat contact receptacle; and a first flat contact in the first flat contact receptacle with a contact surface of the first flat contact forming a side wall of the second flat contact receptacle.

11. The plug-in system according to claim 10, further including a second flat contact having:

(a) at least one contact surface for electrically connecting to the first flat contact, and (b) at least one insulating member upstream of the contact surface in an insertion direction of the second flat contact.

12. The plug-in system according to claim 11, wherein:

(a) the second flat contact is in the second flat contact receptacle, (b) the contact surface of the second flat contact is in electrical contact with the contact surface of the first flat contact, and (c) the insulating member projects beyond the first flat contact receptacle in the second insertion direction.

13. The plug-in system according to claim 12, wherein the at least one insulating member is received in a protrusion of the external wall of the connection cage.

14. The plug-in system according to any one of claim 13, further including a casing:

(a) having a receiving shaft, and (b) surrounding the second flat contact and outwardly freeing the second flat contact at least in the insertion direction of the second flat contact through the receiving shaft.

15. The plug-in system according to claim 14, wherein side walls of the casing surrounding the second flat contact extend further in the insertion direction than the contact surface of the second flat contact.

* * * * *